US005584224A

United States Patent [19]

Davies et al.

[11] Patent Number: 5,584,224

[45] Date of Patent: Dec. 17, 1996

[54] HYDRAULIC SYSTEMS

[75] Inventors: Anthony R. Davies, Cirencester; Stephen J. Downward, Cheltenham; Michael J. Wallace, Brize Norton, all of England

[73] Assignee: Smiths Industries Public Limited Company, London, England

[21] Appl. No.: 541,091

[22] Filed: Oct. 11, 1995

[30] Foreign Application Priority Data

Oct. 20, 1994 [GB] Great Britain ..... 9421149

[51] Int. Cl.[6] ..... F15B 13/16

[52] U.S. Cl. ..... 91/361; 91/366; 91/459

[58] Field of Search ..... 91/361, 459, 366, 91/358 A, 458, 469; 137/627.5

[56] References Cited

U.S. PATENT DOCUMENTS

| | | | |
|---|---|---|---|
| 4,452,267 | 6/1984 | Ott et al. | 137/627.5 X |
| 4,548,296 | 10/1985 | Hasegawa . | |
| 4,585,205 | 4/1986 | Coppola et al. | 91/361 X |
| 4,628,499 | 12/1986 | Hammett | 91/361 X |
| 4,813,339 | 3/1989 | Uno et al. | 91/459 |
| 5,095,804 | 3/1992 | Borch | 91/361 |
| 5,357,878 | 10/1994 | Hare | 91/361 X |

*Primary Examiner*—Hoang Nguyen
*Attorney, Agent, or Firm*—Pollock, Vande Sande & Priddy

[57] ABSTRACT

An hydraulic lift system has an actuator connected to an hydraulic circuit, having a pump, via a supply line. A balanced seated valve is connected between the supply line and a reservoir, the valve being controlled by a solenoid and an electric drive unit. The drive unit supplies a gradually increasing or decreasing voltage to the solenoid to open or close the valve gradually. The valve has a valve member that is displaceable along its length and has a valve head of frusto-conical shape. A passage along the valve member balances fluid pressure across the valve member. The solenoid has an armature with a pole face that can be displaced towards a fixed pole face to unseat the valve member. The pole faces have complementary frusto-conical surfaces and there is a non-magnetic washer between them.

17 Claims, 3 Drawing Sheets

HYDRAULIC SYSTEMS

BACKGROUND OF THE INVENTION

This invention relates to hydraulic systems.

The invention is more particularly concerned with hydraulic lift systems.

Hydraulic systems are often used in applications where people need to be lifted, such as in lifts and ambulance entry platforms. When hydraulic power is supplied to or from the actuator in such systems there can be a very sudden movement, which is disconcerting to the person being lifted. The high initial acceleration of hydraulic lifts can also be a problem where delicate goods are being lifted. It is possible to provide a hydraulic system with a soft start by use of a spool valve and a proportional solenoid. The solenoid is arranged to open or close the spool valve slowly so that hydraulic power supplied to or from the actuator is gradually increased or decreased. This arrangement can work effectively but has two disadvantages. First, the high cost of proportional solenoids and spool valves make them unsuitable for low cost applications. Second, they are unsuitable for applications where a load needs to be held, because their design means that they are inherently leaky.

BRIEF SUMMARY OF THE INVENTION

It is an object of the present invention to provide an improved hydraulic system.

According to one aspect of the present invention there is provided an hydraulic system including an hydraulic actuator, an hydraulic circuit arranged to supply hydraulic power to and from the actuator, and electrical drive means, the hydraulic circuit including an hydraulic power supply and a balanced seated valve having a solenoid for displacing the valve, the electrical drive means being arranged to supply a progressively varying voltage to the solenoid such that the valve is displaced gradually between a fully open position and a fully closed, seated position during at least a part of the time that the voltage is progressively varied so that the acceleration of the actuator can be reduced.

The seated valve may be connected between an hydraulic reservoir and an hydraulic supply line extending between the power supply and the actuator. The system may be arranged to retract the actuator initially by gradually opening the seated valve so that fluid flows to the reservoir at a gradually increasing rate. The system may be arranged such that when the actuator approaches its limit of retraction, the seated valve is gradually closed to reduce progressively the flow of fluid to the reservoir. The system may be arranged to extend the actuator by supplying power from the power supply and initially opening the seated valve fully so that fluid is diverted to the reservoir and then gradually closing the valve so that progressively more fluid flows to the actuator. The valve may be gradually opened as the actuator approaches its limit of extension so that progressively more fluid is diverted to the reservoir. The system may include a creep valve connected in parallel with the seated valve, the creep valve allowing a small flow of fluid to bypass the seated valve. The system preferably includes at least one sensor responsive to the actuator approaching a limit of its movement, the sensor being arranged to provide an output to the electrical drive means for control of the seated valve. The system may include a flow restrictor in line with the seated valve, the flow restrictor limiting flow through the seated valve to a level slightly less than the output of the power supply.

The seated valve preferably has an inlet, an outlet, a valve seat between the inlet and outlet, a displaceable valve member with a valve surface that engages the valve seat to seal the inlet from the outlet, one end of the valve member being exposed at the inlet, and the seated valve having a fluid passage from one side of the valve seat to the other such that pressure at the inlet is balanced across the valve member. The fluid passage preferably extends through the valve member. The seated valve may have a displaceable valve member with a valve surface that is engageable with a valve seat, the valve surface being of frusto-conical shape. The frusto-conical shape may have an angle substantially of 20° to the axis. The solenoid preferably has an armature with a pole face that is displaceable towards a fixed pole face under the action of an electromagnet to unseat the valve, the two pole pieces having complementary frusto-conical surfaces and the solenoid having a member of non-magnetic material between the two pole faces. The solenoid may include means for manually engaging the armature and displacing it along its length such that the seated valve can be opened manually.

According to another aspect of the present invention there is provided a lift system including an hydraulic system according to the above one aspect of the invention and a platform connected to the actuator such that the hydraulic system is operable to raise or lower the platform.

An hydraulic inter floor lift system, in accordance with the present invention, will now be described, by way of example, with reference to the accompanying drawings.

BRIEF DESCRIPTION DRAWINGS

DETAILED DESCRIPTION OF THE PREFERRED EMBODIMENT

Figure 1:
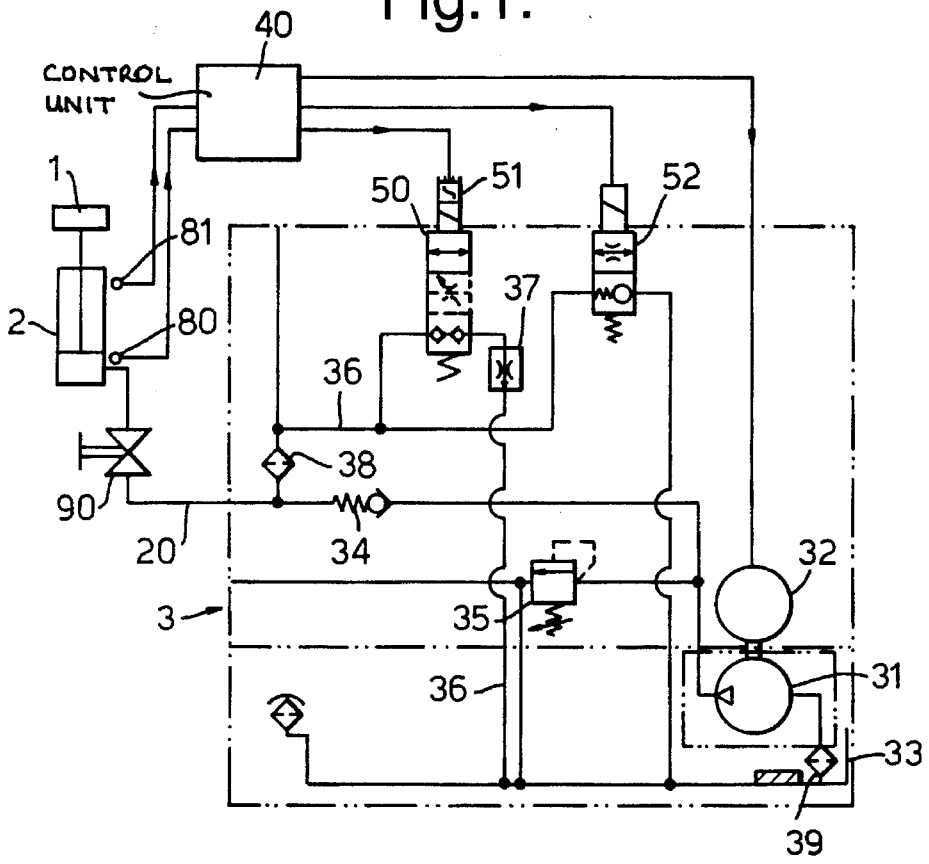
FIG. 1 is a schematic diagram of the system.

With reference to FIG. 1, the inter floor lift system includes a lift platform 1 mounted at the upper end of a lift cylinder or actuator 2, which is shown as being fully extended. Power is supplied to or from the actuator 2 by an hydraulic circuit 3. The system is installed on a lower floor of a building and is arranged to lower the platform 1 vertically from one floor to another, or to raise it from a lower to an upper floor.

A single hydraulic line 20 connects the lower end of the actuator 2 to the hydraulic circuit 3. The hydraulic circuit 3 includes a power supply in the form of a pump 31 driven by an electric motor 32, which is controlled by an electrical drive or control unit 40. The pump 31 is connected between an hydraulic fluid reservoir 33 and the hydraulic line 20 via a one-way, non-return valve 34 that allows fluid to flow from the pump to the hydraulic line 20 but prevents flow in the opposite direction. A pressure relief valve 35 is connected to the line between the pump 31 and the non-return valve 34 so that any excess pressure between the pump and the non-return valve can flow to the reservoir 33.

A pressure return line 36 is connected between the reservoir 33 and the hydraulic line 20. Connected in series in the return line 36 is a balanced double-lock seated valve 50, which will be described in greater detail later. The valve 50 is operated by a solenoid 51 connected to the electrical control unit 40. The return line 36 also includes a flow control valve 37 between the solenoid-operated valve 50 and the reservoir 33. A creep valve 52 is connected in parallel with the solenoid-operated valve 50 to provide an alternative, by-pass return flow path to the reservoir 33.

Filters 38 and 39 are connected between line 20 and the valves 50 and 52, and between the pump 31 and the reservoir 33 respectively.

Figure 2:
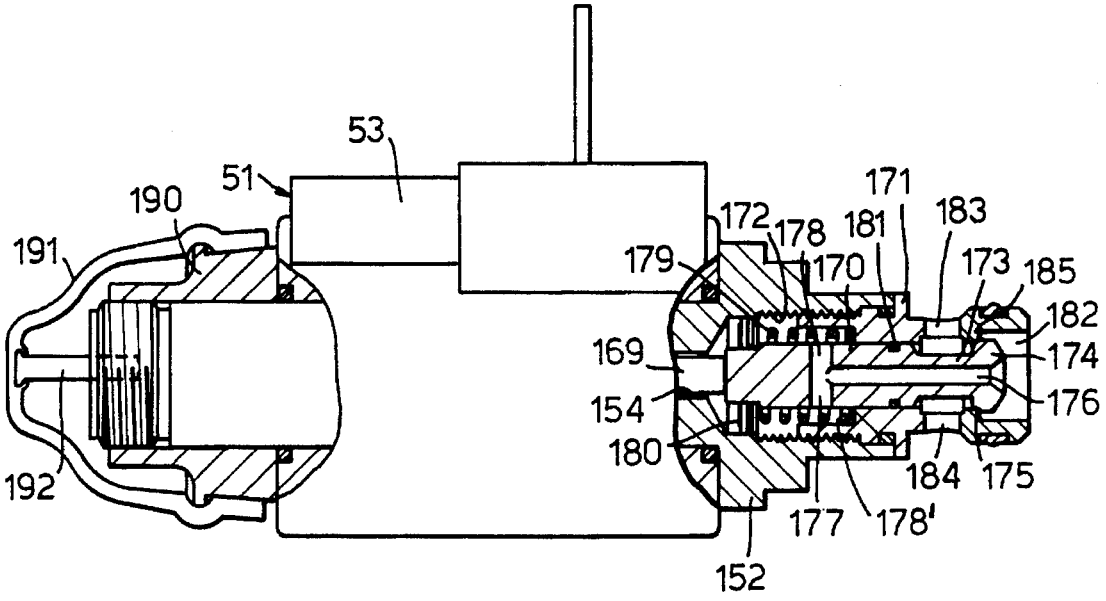
FIG. 2 is a partly sectional side elevation of a part of a valve in the system.
Figure 3:
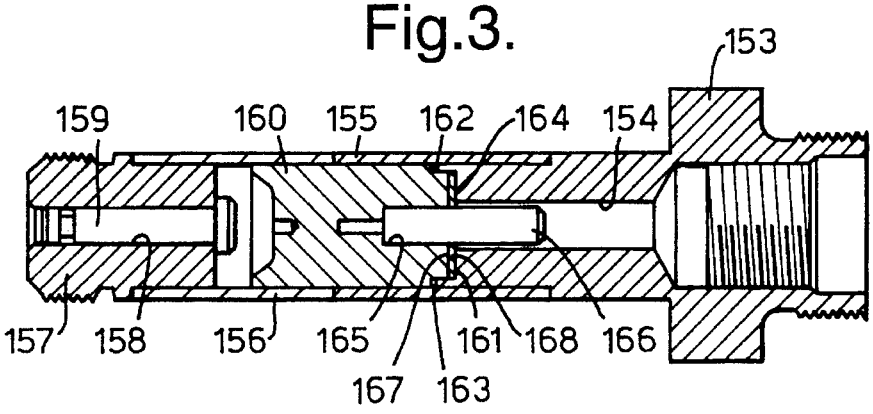
FIG. 3 is a sectional side elevation of a part of the valve of FIG. 2.

With reference now to FIGS. 2 and 3, the valve 50 has a tubular metal housing 152 about the left-hand end of which is mounted the electromagnetic coil 53 of the solenoid 51. The housing 152 forms a part of the solenoid 51 and comprises at its right-hand end a machined block 153 of magnetic material, such as mild steel, with an axial bore 154 extending through it. A sleeve 155 of a non-magnetic material, such as stainless steel, is welded to the left-hand end of the block and this is welded, at its left-hand end, to a second sleeve 156 of a magnetic material, such as mild steel. The left-hand sleeve 156 is welded at its left-hand end to rear block 157 of magnetic material. The rear block 157 has a central bore 158 extending axially through it: in which is slidably located a stainless steel pin 159. Between the two blocks 153 and 157, within the sleeves 155 and 156, is located a magnetic, mild steel armature 160, which also forms a part of the solenoid 51.

The armature 160 is of cylindrical shape and is a sliding fit within the sleeves 155 and 156, the length of the armature being slightly less than the distance between the two blocks 153 and 157, so that there is room for the armature to slide axially within the housing 152. The forward, right-hand pole face 161 of the armature has a narrow step 162 around its circumference with a tapering or frusto-conical wall 163 that reduces in diameter to the right. Within the wall 163 is a central, flat region 164 having an axial recess 165 retaining a projecting stud 166 of a non-magnetic material, which projects into the bore 154 in the block 153, about halfway along its length. The left-hand face 167 of the block 153 forms a fixed pole face of the solenoid and has a complementary shape to that of the pole face 161 with a non-magnetic, anti-residual washer 168 of brass seated against this face of the block. The bore 154 also retains a loose push pin 169 (FIG. 2) of a non-magnetic material. The push pin 169 is movable axially along the bore 154. The left-hand end of the push pin 169 contacts the right-hand of the stud 166. The right-hand end of the push pin 169 contacts the left-hand end of a valve member or poppet 170 located in a sleeve 171 screwed into an enlarged portion 172 at the right-hand end of the bore 154. The poppet 170 is of a generally cylindrical shape and circular section, with a waisted portion 173 of reduced diameter towards its right-hand end. The waisted portion 173 is separated from the right-hand end of the poppet 170 by a valve head 174. The rear, left-hand edge 175 of the head 174 forms a valve surface of a frustoconical shape, being inclined at about 20° to the axis or line of displacement of the poppet 170.

A small diameter axial fluid passage in the form of a bore 176 extends along the poppet 170 from its right-hand end, where it opens externally, to a location about two thirds the way along its length, where it opens externally via two radially-extending bores 177 and 178. The bores 177 and 178 open into an annular recess 178 at the left-hand end of the sleeve 171. The recess 178 receives the right-hand end of a helical spring 179. The left-hand end of the spring 179 bears on the right-hand face of a radially-extending flange 180 secured to the poppet 170 close to its left-hand end, so that the poppet is urged to the left. About midway along its length, the poppet 170 has a sealing ring 181, which makes a sealing, sliding contact with the inside of the sleeve 171.

The sleeve 171 is open at its right-hand end 182 and also opens through two side ports 183 and 184 located in alignment with the waisted portion 173 of the popper 170. Just forwardly of the side ports 183 and 184, there is an internal annular collar 185 of square profile. The right-hand edge of the collar 185 provides a valve seat against which bears the valve surface 175 of the head 174 of the popper 170.

The axial bore 176 and the radial bores 177 and 178 through the poppet 170 allow fluid to flow from the valve inlet formed at the open right-hand end 182 of the sleeve 171, on one side of the poppet 170, to the recess 178, on the other side of the poppet. By having a fluid passage between opposite sides of the valve seat 185, fluid pressure across the poppet 170 is equalized or balanced so that fluid pressure does not significantly hinder opening or closing of the valve.

The valve 50 is connected so that the open end 182 is in fluid communication with the hydraulic line 20 and so that the side ports 183 and 184 communicate with the reservoir 33, or vice versa.

The electromagnet coil 53 of the solenoid 51 is clamped on the tubular housing 152, at its left-hand end, by a nut 190 screwed onto the outside of the housing. A rubber boot 191 encloses the left-hand end of the nut 190 and supports, on its inside, a metal rod 192, which projects into the bore 158 of the block 157 in alignment with the left-hand end of the pin 159. The rod 192 can be displaced manually to the right by pressing in the boot 191. This causes the pin 159 and the armature 160 to be displaced to the right. The resilience of the boot 191 returns the rod to its left-hand position where it is out of contact with the pin 159.

In its natural state, as shown, with no voltage across the solenoid coil 53, the spring 179 holds the poppet 170 in a left-hand position with the head 174 sealingly seated against the valve seat provided by the collar 185. In this position, no fluid can flow between the open end 182 and the ports 183 and 184, so there is no fluid flow along the return line 36. When full power is applied to the solenoid coil 53, the push pin 169 is displaced forwardly, to the right, thereby displacing,the poppet 170 so that its head 174 moves clear of the collar 185, so that fluid can flow between the opening 182 and the ports 183 and 184 around the head. If the valve 50 were opened by applying full power to the solenoid 51 in this way it would result in a sudden flow of fluid out of the actuator 2 to the reservoir 33, limited only by the flow control valve 37. This would allow the lift platform 1 to fall with an initial high acceleration until the flow of fluid along the return line 36 reaches the limit set by the flow control valve 37. Such a high initial acceleration can be frightening to anyone on the platform.

Figure 4A:
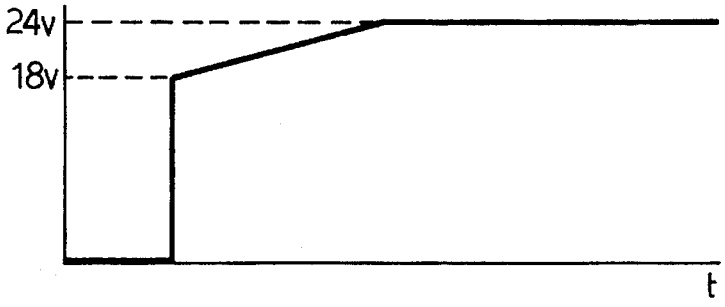
FIGS. 4A to 4C are graphs showing electrical supply to the system.

In the present invention, instead of applying the full voltage across the solenoid 51 immediately, the control unit 40 applies the voltage more gradually, as shown in FIG. 4A. The voltage is initially increased suddenly to about 18 volts, which is below the voltage at which the solenoid generates sufficient power to produce any movement of the popper 170. The voltage is then increased gradually along a linear ramp that rises from 18 volts to 24 volts over a time of about 6 sec. This change in voltage is preferably achieved by using a pulse-width modulation circuit. At some voltage above about 18 volts the power generated by the solenoid 51 will be sufficient to displace the poppet 170 so that its head 174 is just lifted clear of the valve seat 185 and, therefore, allows a small amount of hydraulic liquid to flow through the valve 50. At this time, the lift platform 1 slowly starts to lower. As the voltage increases, the popper 170 is displaced further from the valve seat 185, allowing greater flow of fluid through the valve and thereby allowing the platform to increase in speed slowly. When the voltage reaches the full operating voltage of 24 volts, the poppet 170 will be displaced to its full extent and there will be the maximum flow of fluid through the valve, limited only by the flow control valve 37. After reaching 24 volts, this voltage is maintained constant for as long as the valve needs to be held open.

Figure 5:
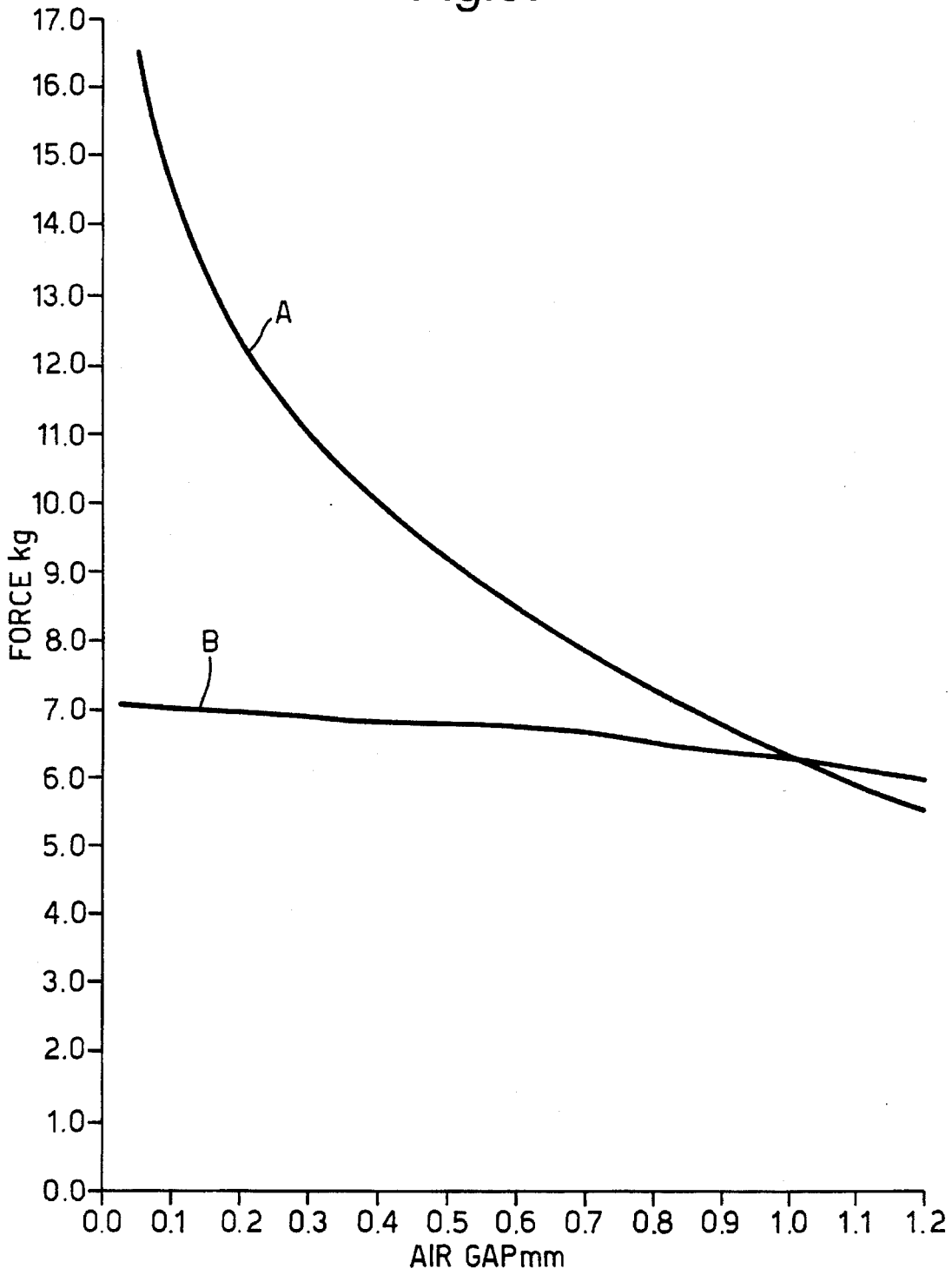
FIG. 5 is a graph illustrating the force characteristic of a solenoid in the valve of FIG. 2.

With reference to FIG. 5, conventional solenoids have a force/displacement characteristic of the kind shown by the line "A". It can be seen that the force in such solenoids increases very rapidly, in a non-linear fashion, as the air gap between its pole pieces decreases. In a valve controlled by a solenoid having such a force characteristic, it would be very difficult to achieve a gradual change in flow through a valve at low flows. The force characteristic of the solenoid 51 used in the valve 50 of the present invention, however, is considerably more linear, as shown by the line "B ". This characteristic is achieved by making the armature 160 and its housing 152 less efficient so that, as the pole faces formed by the right hand end of the armature 160 and the left-hand end of the magnetic block 153 come together, the force maintains substantially constant. The shape of these pole faces, the insertion of the brass washer 168 and the non-magnetic sleeve 155 are effective to flatten the force characteristic sufficiently. The solenoid 51 of the present invention can be used, therefore, to displace gradually the seated valve 50 between a fully open position and a fully closed, seated position by progressively varying the voltage applied to the solenoid coil 53

When the lift system starts in an elevated state, the actuator 2 is fully extended, the pump 31 is off, the creep valve 52 is closed and no power is applied to the solenoid 51. The spring 179 in the valve 50, therefore, holds the poppet 170 against the valve seat 185 so that the valve is closed, thereby preventing any flow of fluid along the return line 36. Because the valve is a seated valve, there is no significant leakage through the valve. The one-way valve 34 prevents any flow of fluid to the pump 31. The platform 1 can, therefore, be held at the elevated position indefinitely without the need to apply any power to the system.

Figure 4B:
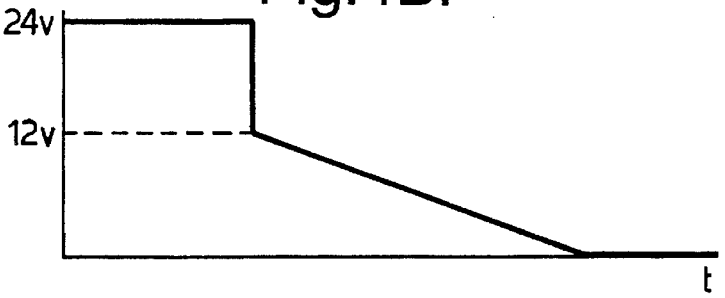

When the platform 1 needs to be lowered, the appropriate button is pressed on the control unit 40. This causes power to be supplied to the solenoid 51 to open gradually the valve in the manner described above so that fluid can flow out of the actuator 2 to the reservoir 33 at a gradually increasing rate via the return line 36. The creep valve 52 is also fully opened so that this allows a small flow of fluid to the reservoir 33. After accelerating gently and reaching its maximum speed, the platform will descend at a constant speed until it comes close to the lower extent of its travel. A detector 80 senses when the platform 1 is a few centimetres above its lower limit, and the actuator 2 approaches its limit of retraction, and provides an output to the control unit 40. This causes the control unit 40 to start reducing power to the solenoid 51, so that the valve 50 gradually closes to reduce progressively the flow to the reservoir 33, and so that a negative acceleration is applied to the platform. When the valve 50 is fully closed, the platform 1 continues its final part of its descent at a slow rate using only the creep valve 52. During this soft stop phase of operation, the voltage is varied in the manner illustrated in FIG. 4B. Initially, the voltage is reduced suddenly to about 12 volts; the voltage then follows a linear downward ramp reducing from 12 volts to zero over a period of 12 sec. When the voltage falls to about 12 volts, the poppet 170 will start to move towards the valve seat 185 and fluid flow through the valve will start to reduce until the voltage reaches some value above zero when the valve 50 will be fully closed.

Figure 4C:
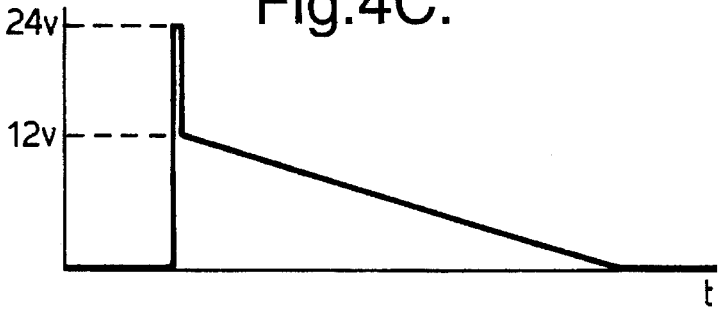

To raise the platform 1, the control unit 40 powers the motor 32 so that the pump 31 is turned on. At the same time as the pump 31 is turned on, the control unit 40 fully opens the valve 50 by suddenly increasing the voltage to the full operating voltage of 24 volts for a short period, as shown in FIG. 4C, so that fluid from the pump 31 is diverted along the return line 36 to the reservoir 33. The flow restrictor 37 is chosen to limit the maximum flow of fluid out of the valve 50 just below the output of the pump 31 so that, even though the valve is fully open, some fluid will flow to the actuator 2, causing it to start to rise at a slow rate. The control unit 40 then reduces the voltage suddenly across the solenoid 51 to about 12 volts so that the valve 50 starts to close. The voltage is subsequently reduced it to zero gradually along a linear ramp over a period of about 12 sec so that the valve 50 closes gradually, thereby allowing a gradually increasing flow of fluid to the actuator 2. Some time before reaching zero volts, the valve 50 will have fully closed and all the hydraulic power from the pump 31 will be flowing to the actuator 2. In this way, the lift platform 1 starts to rise slowly until the maximum flow rate is achieved, as dictated by the characteristics of the pump. If electric power should fail at any time, the valve 50 will remain closed and the non-return valve 34 will close as soon as pressure at the pump 31 falls, so that the lift platform 1 stops and is held in position.

When the platform reaches the top of its travel, an upper limit detector 81 sending a signal to the control unit 40 to provide an output of the kind shown in FIG. 4A to the valve 50 to cause it to start opening slowly. When the valve 50 is fully open, there will still be a small net flow of fluid from the pump 32 to the actuator 2, causing the lift platform to rise slowly over the final few centimetres.

If the system should fail, or power is lost, the platform 1 can be lowered by opening the valve 50 manually, by pushing in the boot 191 and its rod 192. The actuator 2 can be isolated from the hydraulic system 3, if desired, by closing a manual valve 90 connected in the hydraulic line 20 between the actuator and the system.

The arrangement of the present invention can be used with hydraulic systems that are required to hold a load, because the system employs a seated valve with substantially no leakage. The system can be used to provide a soft start or soft stop facility in low cost applications where valves controlled by a proportional solenoid would be too expensive. The invention is not confined to systems operating in a vertical plane but can be used to control the rate of increase or decrease of flow into any hydraulic circuit.

What we claim is:

1. In an hydraulic system of the kind having an hydraulic actuator, an hydraulic power supply, an hydraulic circuit operative to supply hydraulic power to and from the actuator, and an electrical drive unit operative to control operation of the hydraulic circuit, the improvement wherein the hydraulic system includes a balanced seated valve connected in said circuit, said valve including a housing having an opening, an outlet, a valve seat disposed between said opening and said outlet, a valve member operative to seal on said seat and prevent flow between the opening and the outlet, and a fluid passage between opposite sides of the valve seat so that fluid pressure acting on the valve member is substantially balanced, said valve including a solenoid operative to engage and displace the valve member away from said valve seat, and the system including a connection between said electrical drive unit and said solenoid, said electrical drive unit being operative to supply a progressively varying voltage to said solenoid such that said valve member is displaced gradually between a fully open position away from said valve seat and a fully closed position in sealing engagement with said valve seat during at least a part of the time that the voltage is progressively varied so that flow of fluid through the valve between the opening and the outlet is varied and the acceleration of the actuator is reduced.

2. An hydraulic system according to claim 1, including an hydraulic reservoir, a first hydraulic supply line extending between said power supply and said actuator, and a second hydraulic supply line extending between said first hydraulic supply line and said reservoir, said seated valve being connected in said second supply line.

3. An hydraulic system according to claim 2, wherein said electrical drive means is operable to retract said actuator by initially gradually opening said seated valve so that fluid flows to said reservoir at a gradually increasing rate.

4. An hydraulic system according to claim 2, wherein said electrical drive means is operable gradually to close said seated valve when the actuator approaches its limit of retraction so as to reduce progressively the flow of fluid to the reservoir.

5. An hydraulic system according to claim 2, wherein said hydraulic circuit is operable to extend said actuator by supplying power from said power supply and initially opening said seated valve fully so that fluid is diverted to said reservoir and then gradually closing said valve so that progressively more fluid flows to said actuator.

6. An hydraulic system according to claim 5, wherein said electrical drive unit gradually opens said valve as said actuator approaches its limit of extension so that progressively more fluid is diverted to said reservoir.

7. An hydraulic system according to claim 1, wherein the system includes a creep valve, and a connection connecting said creep valve in parallel with said seated valve, said creep valve allowing a small flow of fluid to bypass said seated valve.

8. An hydraulic system according to claim 1 including at least one sensor responsive to the actuator approaching a limit of its movement, and a connection between said sensor and said electrical drive unit for control of said seated valve.

9. An hydraulic system according to claim 1, including a flow restrictor, an in-line connection between said flow restrictor and said seated valve, said flow restrictor limiting flow through said seated valve to a level slightly less than the output of said power supply.

10. An hydraulic system according to claim 1, wherein said fluid passage extends through said valve member.

11. An hydraulic system according to claim 1, wherein said valve member has a valve surface that is engageable with said valve seat, said valve surface being of frusto-conical shape.

12. An hydraulic system according to claim 11, wherein the frusto-conical shape has an angle substantially of 20° to a line of displacement of the valve member.

13. An hydraulic system according to claim 1, wherein said solenoid has an electromagnet, a fixed pole face and an armature with a pole face, said pole face on said armature being displaceable towards said fixed pole face under the action of said electromagnet so that the valve is unseated, and said solenoid having a member of non-magnetic material between said two pole faces.

14. An hydraulic system according to claim 1, wherein said solenoid has an electromagnet, a fixed pole face and an armature with a pole face, said pole face on said armature being displaceable towards said fixed pole face under the action of said electromagnet so that the valve is unseated, and said pole faces having complementary frusto-conical surfaces.

15. An hydraulic system according to claim 1, wherein said solenoid has an armature that is displaceable along its length, said solenoid including a manually-displaceable member aligned to engage said armature and displace it along its length such that said seated valve can be opened manually.

16. An hydraulic lift system comprising: a lift platform; an hydraulic actuator connected to said lift platform to raise and lower the platform; an hydraulic circuit operative to supply hydraulic power to and from the actuator; a balanced seat valve connected in said circuit, said valve including a housing, said housing having an opening, an outlet, and a valve seat disposed between said opening and said outlet; a valve member operative to seal on said seat and prevent flow between the opening and the outlet; a fluid passage between opposite sides of the valve seat so that fluid pressure acting on the valve member is substantially balanced, a solenoid operative to engage and displace the valve member away from said valve seat; an electrical drive unit and a connection between said electrical drive unit and said solenoid, said electrical drive unit being operative to supply a progressively varying voltage to said solenoid such that said valve member is displaced gradually between a fully open position away from said valve seat and a fully closed position in sealing engagement with said valve seat during at least part of the time that the voltage is progressively varied so that flow of fluid through the valve between the opening and the outlet is varied and the acceleration of the lift platform is reduced.

17. An hydraulic lift system according to claim 16 including two sensors located to detect movement of said actuator close to its opposite limits of displacement, and a connection between said sensors and said electrical drive unit such that said electrical drive unit supplies signals to said solenoid to reduce gradually the speed of said lift platform as it approaches an upper or lower limit of movement.

* * * * *